US005893278A

United States Patent [19]

Float et al.

[11] Patent Number: 5,893,278

[45] Date of Patent: Apr. 13, 1999

[54] EARRING HAVING AN IMPROVED RETAINING MECHANISM

[76] Inventors: Ardele Y. Float; Kenneth W. Float, both of 2 Shire, Coto de Caza, Calif. 92679

[21] Appl. No.: 08/931,037

[22] Filed: Sep. 16, 1997

[51] Int. Cl.[6] ..... A44C 7/00

[52] U.S. Cl. ..... 63/12; 24/705; 24/706.6; 24/706.9

[58] Field of Search ..... 24/705, 706.6, 24/706.9; 63/12

[56] References Cited

U.S. PATENT DOCUMENTS

| | | | |
|---|---|---|---|
| 531,397 | 12/1894 | Stephenson | 24/706.6 |
| 982,727 | 1/1911 | Jones | 24/706.9 |
| 986,874 | 3/1911 | Thomlinson | 24/706.6 X |
| 1,018,290 | 2/1912 | Barbalicz | 24/706.6 |
| 1,073,360 | 9/1913 | Morgan | 24/706.6 |
| 1,092,536 | 4/1914 | Olechnowicz | 24/706.6 |
| 1,184,369 | 5/1916 | Mote | 24/706.6 |
| 1,262,058 | 4/1918 | Koch | 24/706.6 |
| 1,576,376 | 3/1926 | Sudekum | 24/706.6 X |
| 5,018,365 | 5/1991 | Luceno | 63/12 |
| 5,456,094 | 10/1995 | Greenwald | 63/12 |

FOREIGN PATENT DOCUMENTS

| | | | |
|---|---|---|---|
| 598464 | 12/1925 | France | 24/706.9 |
| WO 92/21262 | 12/1992 | WIPO | 63/12 |

*Primary Examiner*—Brian K. Green
*Assistant Examiner*—Andrea Chop
*Attorney, Agent, or Firm*—Kenneth W. Float

[57] ABSTRACT

An improved retaining mechanism for use with a pierced earring having an ornament having a stem. The retaining mechanism has a base with an opening therein through which the stem of the earring passes, a cylindrical tube extending from the base with threads on an external surface. An inner wall of the tube tapers from its open end toward the base. A cap is provided that has a closed end with an opening therein through which the stem of the earring passes. The cap has threads formed on an inner surface that mate with the threads on the external surface of the cylindrical tube. A tapered member extends from the closed end of the cap and is tapered along its exterior wall. The external taper of the tapered member substantially matches the internal taper of the cylindrical tube. The tapered member has a slot formed in its wall. A compressible member is secured in the tapered member and has an opening therethrough that is aligned with the openings in the base and the cap, and has a slot that is aligned with the slot in the tapered member. The tapered member may have one or more circumferential projections, with the tapered inner surface of the cylindrical tube having a mating groove, or vice-versa. The projection and groove engage each other when the cap and base are screwed together so that they do not inadvertently disengage.

20 Claims, 1 Drawing Sheet

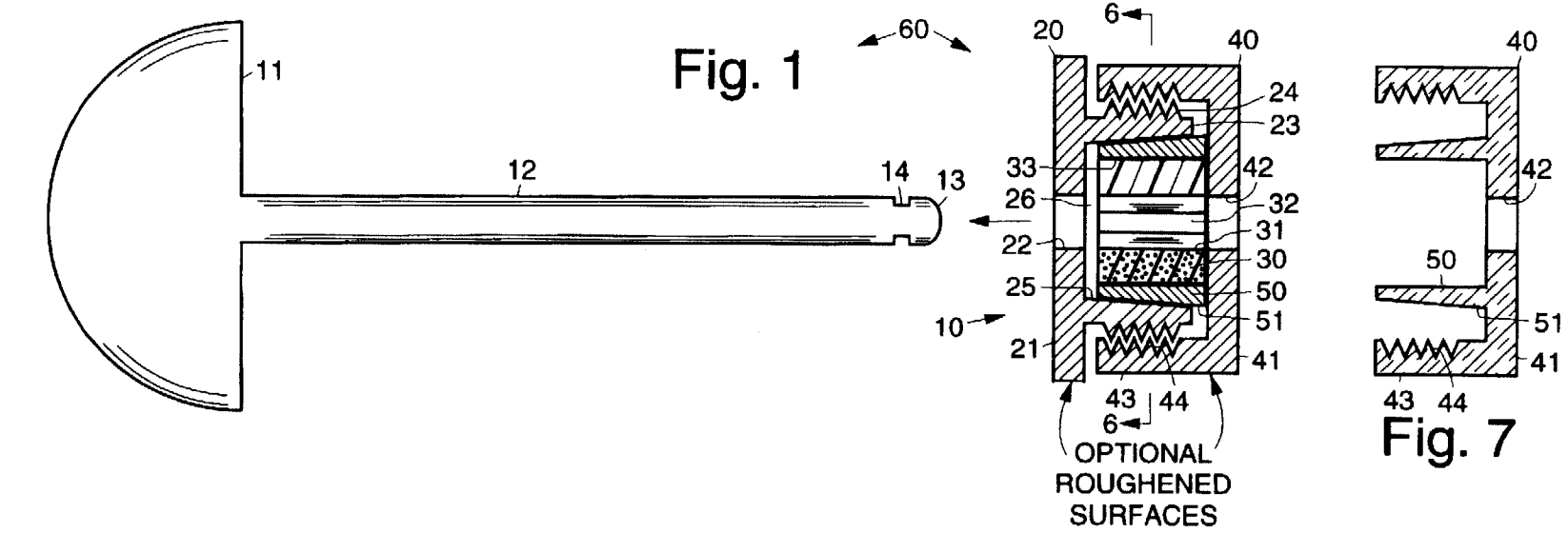
Fig. 1
Fig. 7
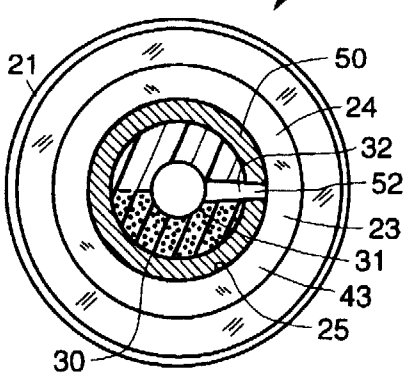
Fig. 6
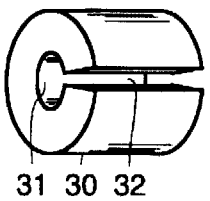
Fig. 5
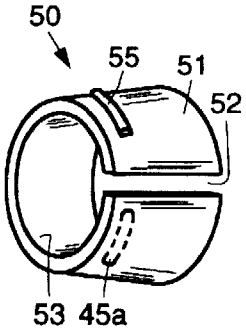
Fig. 4
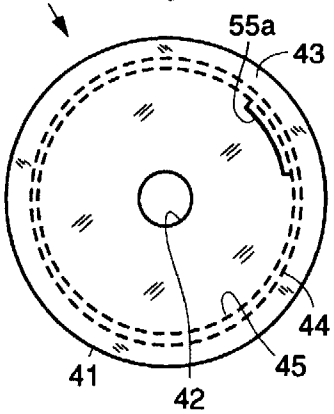
Fig. 3
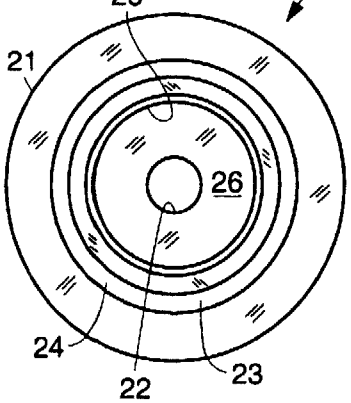
Fig. 2

EARRING HAVING AN IMPROVED RETAINING MECHANISM

BACKGROUND

The present invention relates generally to pierced earrings, and more particularly, to pierced earrings having improved retaining mechanisms.

Pierced earrings are made of an ornament that is part of or is secured to a stem that is inserted through the ear.1

Conventional pierced earrings are made using a variety of earring locking, fastening or retaining mechanisms.

One simple retaining mechanism includes a disk with an opening therein that slides over the stem and is held on by means of friction between the stem and the opening caused by an interference fit between the stem and the opening. Typically, the stem has a groove that is used to retain the disk on the stem if it slides away from the ornament to the end of the stem. However, the disks may be easily and inadvertently removed from the stem when hair is brushed, or if the ear or body in the vicinity of the earring is fondled. Consequently, the retainer may be lost or the earring may be lost because the retainer does not reliably stay on the stem.

Another convention retaining mechanism is a screw-on type device wherein the conventional stem of the earring is removed by a jeweler and is replaced by a threaded stem. The threaded stem is sized to mate with the opening in the disk of the retainer, or with a new retainer having an opening sized to match the threaded stem, and which is threaded onto the stem to retain the earring on the ear or other body part. However, although this type of retainer is more reliable than the simple sliding retainer, it also can be inadvertently removed from the ear or body, and the retainer or earring may be lost. Furthermore, there is added cost in that the earring must be reworked by the jeweler to attach the threaded stem onto the back of the earring. Consequently, this arrangement is normally used only on relatively expensive earrings.

A third convention retaining mechanism is known as a "French clasp". The French clasp has a spring-loaded loop that is spring-loaded against the back of the ear when in use. However, the spring force is typically not high so that the earring is not uncomfortable for the wearer. Consequently, the spring-loaded loop may be inadvertently opened which will allow the earring to drop from the ear and be lost.

A fourth convention retaining mechanism is one wherein the stem pivots around an axis on one part of the earring and is secured by pressing the end of the stem distal from the axis into a U-shaped groove whose entry opening is less than the diameter of the stem and separates to allow the stem to be retained in the groove. The differences in the respective diameters of the stem and the groove are typically chosen so that it is relatively easy to insert and remove the stem from the groove, but is adequate to retain the stem in the groove. However, as with the other conventional retainers, the stem can be inadvertently pulled out of the groove which will allow the earring to be lost.

Unfortunately, the conventionally available earring retainers suffer from one or more problems that typically result in the eventual loss of an earring, or require additional cost and time to retrofit threaded stems to use screw-on-type fasteners.

Accordingly, it is an objective of the present invention to provide for an earring having a retaining mechanism that improves over the above-described conventional retainers.

SUMMARY OF THE INVENTION

To accomplish the above and other objectives, the present invention provides for an improved earring, and improved retaining mechanisms for use with earrings that may be used with any pierced earring having a stem that is inserted through the ear. Conventional earrings do not need to be modified in any way to use the present retaining mechanism.

The retaining mechanism has a base with an opening therein through which the stem of the earring passes. A cylindrical tube extends from the base that has threads on an external surface. An inner wall of the cylindrical tube tapers from its open end toward the base. The retaining mechanism has a cap with a closed end that has an opening therein through which the stem of the earring passes. The cap also has a cavity with internal threads formed on its inner surface that mate with the threads on the external surface of the cylindrical tube. The openings in the base and cap need not have an interference fit relative to the stem.

The closed end of the cap has a cylindrical tapered member extending therefrom. The cylindrical tapered member is tapered along its exterior wall and has a taper that substantially matches the internal taper of the cylindrical tube of the base. The cylindrical tapered member has a slot formed in its wall and thus has a C-shaped cross section.

A compressible member is secured in the cylindrical tapered member. The compressible member has an opening therethrough that is aligned with the openings in the base and the cap. The compressible member has a slot therein that is aligned with the slot in the cylindrical tapered member.

An aid may also be provided for use in securing the base and the cap together. The exterior surface of the tapered member may have a groove formed therein that mates with a corresponding projection, or individual projections, formed on the interior surface of the cylindrical tube. Alternatively, the tapered member may have a projection, or individual projections, formed thereon, while the tapered inner surface of the cylindrical tube has a mating groove.

In operation, the base and the cap are partially threaded together, and slid onto the stem to a comfortable position. The base may be held with the thumb and finger of one hand while the cap is threaded onto the base with the other hand. Tightening the threads compresses the tapered member which also compresses the compressible member around the stem, thus securing the retaining mechanism to the stem. If the groove and projection(s) are used, the base and the cap are threaded together until the groove and projection(s) engage each other, which aids in insuring that the retaining mechanism will not be inadvertently removed from the stem.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 1 illustrates an embodiment of a pierced earring employing a retaining mechanism in accordance with the principles of the present invention;

FIG. 2 is an end view of the base of the retaining mechanism;

FIG. 3 is an end view of a cap of the retaining mechanism;

FIG. 4 shows a perspective view of a tapered member used in the retaining mechanism of FIG. 1;

FIG. 5 shows a perspective view of a compressible member used in the retaining mechanism of FIG. 1;

FIG. 6 is a cross sectional view of the retaining mechanism of FIG. 1 taken along the lines 6—6; and FIG. 7 is a cross sectional view of an integrated cap and tapered member that may be used in the retaining mechanism of FIG. 1.

DETAILED DESCRIPTION

Referring to the drawing figures, FIG. 1 illustrates an embodiment of a pierced earring 60 employing a retaining mechanism 10 in accordance with the principles of the present invention. The pierced earring 60 are made of an ornament 11 that is part of or is secured to a stem 12 that is inserted through an ear or other portion of the body (not shown). An end 13 of the stem 12 distal from the ornament 11 typically has a groove 14 formed therein that is used to retain a conventional retaining mechanism on the stem 12 if it slides to the end of the stem 12. The groove 14 is shown because it is formed on the stems most conventional earrings. However, it is to be understood that the groove 14 is not part of or used in the present invention.

The retaining mechanism 10 comprises a base 20 having an opening 22 therein through which the stem 12 of the earring 60 passes. FIG. 2 shows an end view of the base 20. If the base 20 is circular, then the periphery of the base 20 may be knurled or roughened so that it may be easily held in with the thumb and finger. The opening 22 in the base 20 need not have an interference fit relative to the stem 12. A cylindrical tube 23 extends from the base 20 that has threads 24 on an external surface. A cavity 26 is thus formed between the base 20 and the cylindrical tube 23. An inner wall 25 of the cylindrical tube 23 tapers from its open end toward the base 20. The base 20 and cylindrical tube 23 may be machined out of metal, or may be made of molded plastic.

The retaining mechanism 10 comprises a cap 40 that has a closed end 41 with an opening 42 therein through which the stem 12 of the earring 60 passes. FIG. 3 shows an end view of the cap 40. The opening 42 in the cap 40 need not have an interference fit relative to the stem 12. If the cap 40 is circular, then its periphery may be knurled or roughened so that it may be easily held in with the thumb and finger. The cap 40 has a cylindrical cavity 45 and threads 44 are formed on its inner surface that mate with the threads 24 on the external surface of the cylindrical tube 23.

The closed end 41 of the cap 40 has a tapered member 50 extending therefrom. The tapered member 50 may be cylindrical. FIG. 4 shows a perspective view of the tapered member 50. The tapered member 50 be a separate component that is secured to the closed end 41 of the cap 40 such as by soldering, welding or by means of adhesive, or the like. Alternatively, the closed end 41 of the cap 40 and the tapered member 50 may be formed as a single piece, such as by machining the cap 40 from metal or by molding the cap 40 out of plastic. The tapered member 50 is tapered along its exterior wall 51 and has a taper that substantially matches the internal taper of the cylindrical tube 23 that is part of the base 20. The tapered member 50 has a slot 52 formed in its wall 51 and thus has a C-shaped cross section.

The tapered member 50 may have a circumferential projection 55, or individual projections 55, formed thereon, while the tapered inner surface of the cylindrical tube 23 has a mating groove 45. Conversely, the exterior surface of the tapered member 50 may have a groove **45*a* (a portion of which is shown in FIG. 3 in dashed lines formed therein that mates with a corresponding projection 55*a* (a portion of which is shown in FIG. 4), or individual projections, formed on the cylindrical tube 23. The projection(s) 55 and groove 45 may be formed as part of the machining operation if the retaining mechanism 10 comprises a metal base 20 and cap 40, or may be formed as part of the molding process if the retaining mechanism 10 comprises a plastic base 20 and cap 40. The projection(s) 55 and groove 45 aid in securing the base 20 and the cap 40 together so that the cap 40 does not inadvertently disengage from the base 20**.

A compressible member 30, which may be cylindrical, is secured in the tapered member 50, and may also be secured to the closed end 41 of the cap 40. FIG. 5 shows a perspective view of the compressible member 30. The compressible member 30 has an opening 31 therethrough that is aligned with the openings 22, 42 in the base 20 and the cap 40, and through which the stem 12 of the earring 60 passes. The compressible member 30 has a slot 32 therein that is aligned with the slot 52 in the tapered member 50. The compressible member 30 may be made of rubber, compressible plastic, or a foam material that is compressible to hold the stem 12 and which substantially returns its original shape when the cap 40 is unscrewed from the base 20 to allow the stem 12 to slide from the retaining mechanism 10.

FIG. 6 is a cross sectional view of the retaining mechanism 10 of FIG. 1 taken along the lines 6—6. FIG. 6 shows more clearly the slots 52, 32 in the tapered member 50 and the compressible member 30 which allow the compressible member 30 to be squeezed to firmly hold the stem 12 of the earring 60.

In operation, the stem 12 of the earring 60 is inserted through a hole in the ear or other part of the body. The base 20 and the cap 40 of the retaining mechanism 10 are partially threaded together, and slid onto the stem 12 of the earring 60 to a comfortable position on the ear or other part of the body. The base 20 is held with the thumb and finger of one hand while the cap 40 is threaded onto the base 20 with the other hand. Tightening the threads 24, 44 compresses the tapered member 50 which also compresses the compressible member 30 around the stem 12, thus securing the retaining mechanism 10 to the stem 12. If the groove 55 and projection(s) 45 are formed on the tapered member 50 and the cylindrical tube 23, the base 20 and the cap 40 are threaded together until the groove 55 and projection(s) 45 engage each other. This insures that the retaining mechanism 10 will not be inadvertently removed from the stem 12.

Referring now to FIG. 7, it is a cross sectional view of an integrated cap 40 and tapered member 50 that may be used in the retaining mechanism 10 of FIG. 1. The integrated cap 40 and tapered member 50 may be made of plastic, as is indicated by the cross-hatching in FIG. 7, or it also may be made of metal as has been mentioned above.

As was mentioned above, it is to be understood that either the base 20 or the cap 40 of the retaining mechanism 10 may be separately formed from metal or plastic, for example. For instance, one embodiment of the mechanism 10 may comprise a plastic base 20 used in conjunction with a plastic cap 40. Another embodiment of the mechanism 10 may comprise a plastic base 20 used in conjunction with a metal cap 40. Another embodiment of the mechanism 10 may comprise a metal base 20 used in conjunction with a metal cap 40. Yet another embodiment of the mechanism 10 may comprise a metal base 20 used in conjunction with a plastic cap 40. In any of these embodiments, the tapered member 50 may be formed as part of the cap or may be a separate component, although it is preferrably retained with the cap 40. Also, the tapered member 50 may be formed from metal or plastic, for example.

Thus, pierced earrings and improved retaining mechanisms therefor have been disclosed. It is to be understood that the described embodiments are merely illustrative of some of the many specific embodiments that represent applications of the principles of the present invention. Clearly, numerous and other arrangements can be readily devised by those skilled in the art without departing from the scope of the invention.

What is claimed is:

1. A pierced earring comprising:

an ornament having a stem; and a retaining mechanism comprising:

a base having an opening therein through which the stem of the earring passes, and a cylindrical tube extending from the base that has threads on an external surface and a flared inner wall;

a cap having a closed end with an opening therein through which the stem of the earring passes and having threads formed on an inner surface that mate with the threads on the external surface of the cylindrical tube;

a tapered member extending from the closed end of the cap that is tapered along an exterior wall and has a taper that substantially matches the flare of the inner wall of the cylindrical tube, and that has a slot formed in the exterior wall, the exterior wall of the tapered member abutting the inner wall of the cylindrical tube and;

a compressible member disposed in the tapered member and having an opening therethrough that is aligned with the openings in the base and the cap, and having a slot therein.

2. The earring of claim 1 wherein the base, cap and tapered member comprise metal.

3. The earring of claim 1 wherein the base, cap and tapered member comprise plastic.

4. The earring of claim 1 wherein the peripheries of the base and cap are roughened.

5. The earring of claim 1 wherein the tapered member is secured to the closed end of the cap.

6. The earring of claim 1 wherein the tapered member is soldered to the closed end of the cap.

7. The earring of claim 1 wherein the tapered member is welded to the closed end of the cap.

8. The earring of claim 1 wherein the tapered member is adhesively secured to the closed end of the cap.

9. The earring of claim 1 wherein the tapered member and the cap are formed as a single piece.

10. The earring of claim 1 wherein the tapered member has a projection formed thereon, and the inner wall of the cylindrical tube has a mating groove.

11. The earring of claim 1 wherein the exterior wall of the tapered member has a groove formed therein that mates with a corresponding projection formed on the cylindrical tube.

12. The earring of claim 1 wherein the compressible member is secured to the closed end of the cap.

13. The earring of claim 1 wherein the compressible member comprises rubber.

14. The earring of claim 1 wherein the compressible member comprises a foam material.

15. The earring of claim 1 wherein the compressible member comprises plastic.

16. A retaining mechanism for use with a pierced earring having an ornament having a stem, said retaining mechanism comprising:

a base having an opening therein, and a cylindrical tube extending from the base that has threads on an external surface and a flared inner wall;

a cap having a closed end with an opening therein and having threads formed on an inner surface that mate with the threads on the external surface of the cylindrical tube;

a tapered member extending from the closed end of the cap that is tapered along an exterior wall and has a taper that substantially matches the flare of the inner wall of the cylindrical tube, and that has a slot formed in the exterior wall, the exterior wall of the tapered member abutting the inner wall of the cylindrical tube and;

a compressible member disposed in the tapered member and having an opening therethrough that is aligned with the openings in the base and the cap, and having a slot therein.

17. The retaining mechanism of claim 16 wherein the base, cap and tapered member comprise metal.

18. The retaining mechanism of claim 16 wherein the base, cap and tapered member comprise plastic.

19. The retaining mechanism of claim 16 wherein the tapered member has a projection formed thereon, and the inner wall of the cylindrical tube has a mating groove.

20. The retaining mechanism of claim 16 wherein the exterior wall of the tapered member has a groove formed therein that mates with a corresponding projection formed on the cylindrical tube.

* * * * *